United States Patent [19]

Volkov et al.

[11] 4,047,672

[45] Sept. 13, 1977

[54] APPARATUS FOR DISINTEGRATION OF MATERIALS

[76] Inventors: Vladimir Vladimirovich Volkov, ulitsa Zolotodlinskaya, 34, kv. 2; Gennady Ivanovich Bagryantsev, ulitsa Zhemchuzhnaya, 12, kv. 24; Igor Grigorievich Larionov, morskoi prospekt, 21, kv. 15; Alexandr Filippovich Neermolov, Vesenny proezd, 6, kv. 45; Valery Georgievich Leontievsky, Tsvetnoi proezd, 19, kv. 36, all of Novosibirsk, U.S.S.R.

[21] Appl. No.: 725,925

[22] Filed: Sept. 23, 1976

Related U.S. Application Data

[63] Continuation of Ser. No. 585,515, June 10, 1975, abandoned.

[51] Int. Cl.[2] ..... B02C 17/14

[52] U.S. Cl. ..... 241/175; 241/65; 241/69; 241/DIG. 14

[58] Field of Search ..... 241/65, 69, 170, 171, 241/175, DIG. 14

[56] References Cited

U.S. PATENT DOCUMENTS

| | | | |
|---|---|---|---|
| 292,338 | 1/1884 | Maynadier | 241/69 |
| 2,552,360 | 5/1951 | Zichis | 241/DIG. 14 |
| 3,067,956 | 12/1962 | Tove | 241/65 X |
| 3,212,722 | 10/1965 | Maeder et al. | 241/69 X |
| 3,346,200 | 10/1967 | Lesin et al. | 241/175 |
| 3,814,334 | 6/1974 | Fynk | 241/65 X |

*Primary Examiner*—Roy Lake
*Assistant Examiner*—Howard N. Goldberg
*Attorney, Agent, or Firm*—Holman & Stern

[57] ABSTRACT

An apparatus intended for carrying out various mechanico-chemical processes for production of borohydrides and comprises an airtight shell with three compartments. The top compartment serves as a material charging chamber, whereas the middle compartment accommodates grinding solids and a vibrator rod which passes through the charging chamber and is mechanically disengaged from the shell of the apparatus, the chamber with grinding solids being suspended on the vibrator rod. The bottom compartment serves for discharge of the disintegrated products therefrom. During operation of the apparatus, reciprocating motion is imparted to the vibrator rod along and around its own axis. This results in the grinding-solid chamber being set in motion so that the material fed from the charging chamber is vigorously disintegrated. The rod portion arranged within the zone of the hole communicating the charging chamber and the grinding-solid chamber, has a cone-shaped boss which contributes to a proper proportioning of the material under process.

5 Claims, 5 Drawing Figures

APPARATUS FOR DISINTEGRATION OF MATERIALS

This is a continuation of application Ser. No. 585,515 filed June 10, 1975, now abandoned.

BACKGROUND OF THE INVENTION

The present invention relates to apparatus used in chemical engineering, and more specifically, to apparatus intended for disintegration of materials.

The present invention can find most utility when used in mechanico-chemical processes for producing derivatives of boron hydrides, such as borazine, which is an inorganic cyclic compound having the formula $B_3N_3H_6$, by reacting borohydrides of alkali metals and ammonium halides.

Known at present are vibration-type apparatus for disintegration of materials, such as vibromills. The apparatus comprise a chamber with grinding solids, the chamber being made in the form of a shell with holes for charging the stock material into and for discharging the disintegrated material from the chamber, the discharge hole being provided with a screen to retain the grinding solids in the chamber and to pass the disintegrated material away from the chamber. The chamber is suspended on shock absorbers and is driven by a vibrator. The vibrator may be made as a shaft secured on the outside of the chamber shell, the shaft resting upon the bearings and being provided with an out-of-balance flywheel or an eccentric. The shaft is coupled with an electric motor.

A cone-shaped chamber is used for charging the material, whose bottom is provided with a proportioner and a pipe through which the material is fed into the chamber accommodating the grinding solids.

To provide an airtight continuous feed of material, the cone-shaped charging chamber communicates with the chamber containing the grinding solids through a flexible hose or bellows. In a similar way the latter chamber communicates with other pipings used to feed to or discharge from the chamber some gas, liquid, as well as disintegrated solid products.

With the motor energized, the vibrator imparts oscillating motion to the grinding-solid chamber. As a result, the grinding solids move in the chamber along with the material to disintegrate the latter, whereupon the disintegrated products are discharged from the chamber through the corresponding holes therein.

Known also are apparatus comprising a number of grinding solid chambers intercommunicated either in series or in parallel.

All the known apparatus for disintegration of materials differ from one another in construction and shape of the materials disintegration chamber, mutual arrangement of the chamber and the vibrator, as well as in the method of feeding the material being disintegrated into the chamber and discharging the disintegrated material therefrom.

A common engineering principle inherent in all the known apparatus is the provision of flexible elements, such as hoses or bellows tightly communicating the chamber interior with various devices (charging chamber, device for discharge of the disintegrated products, etc.).

However, the provision of the flexible elements is a substantial disadvantage of the known apparatus, since the use of the flexible elements interferes with the material disintegration progress under high pressures and at a continuous feed of the material into the grinding-solid chamber.

Moreover, the bellows and the hoses are liable to excess wearout, need frequent replacement and fail to possess the reliability high enough to provide airtightness of the apparatus, which involves extra expenditures and adversely affects the apparatus service life.

Furthermore, the movable elements of the apparatus feature an abnormally high specific metal consumption, which results in a waste of electric power, excess wearout of shock absorbers and vibrator bearings.

A material disadvantage of the known apparatus resides also in high operating noise level, which needs special measures for noise suppression and, consequently, involves extra costs.

Apart from all the mentioned above, one more disadvantage of the apparatus is inconvenience in their attendance, this being due to the fact that access to an operating apparatus is hampered on account of the grinding-solid chamber being in constant motion. This interferes with visual checkout during the materials disintegrating process and requires extra expenditures to provide safety for the attending personnel.

SUMMARY OF THE INVENTION

It is an object of the present invention to provide an airtight apparatus for disintegration of material and for performing various mechanico-chemical processes.

It is another object of the present invention to provide such an apparatus for disintegeration of material that is reliable in operation.

It is still another object of the present invention to provide such an apparatus for disintegration of material that is highly efficient in utilization of electric power.

It is yet still another object of the present invention to provide such an apparatus for disintegration of material that features low operating noise level.

It is one more object of the present invention to provide such an apparatus for disintegration of material that is convenient in operation.

These and other objects and advantages of the herein-disclosed invention are achieved due to the fact that in an apparatus for disintegration of material, wherein a grinding-solid chamber communicates with a vibrator and with a material charging chamber, as well as with a device for discharge of the disintegrated products, provision is made according to the invention, for an airtight shell with three compartments, of which the top one serves as the material charging chamber and communicates with the middle compartment accommodating the grinding-solid chamber, whereas the bottom compartment serves as the device for the discharge of the disintegrated products and also communicates with the middle compartment, the vibrator being provided with a rod inserted into the material charging chamber so that the rod is mechanically disengaged from the shell and rigidly connected with the grinding solid chamber to impart oscillating motion to the chamber, with the result that disintegration of material under process occurs therein.

The herein-disclosed apparatus is simple in construction and compact.

The herein-proposed apparatus is free of external movable elements and, due to its airtightness and the mechanical disengagement of the vibrator rod from the shell, the operating noise level of the apparatus has been considerably decreased. This makes it possible to visually observe the material disintegration process during operation of the apparatus, improve the operating conditions of the apparatus and ensure an efficient utilization of electric power.

The herein-proposed construction of the apparatus enables the apparatus to be used in carrying out various mechanico-chemical processes involving the mechanical treatment of the material, heating or cooling of the material in the course of its processing and creation of a requisite gaseous medium inside the apparatus.

It is expedient that the rod portion passing beyond the material charging chamber be fixed to a tube containing a core, the tube being connected to the shell through springs and housing a sleeve which in sealingly connected to the shell interior of the apparatus and is embraced with a pair of solenoid coils fitted in magnetic yokes. The core is provided with longitudinal slots, whereas the magnetic yoke internal surface has slots so arranged that when the core assumes a definite position, its slots are situated opposite the slots on one of the magnetic yokes.

The herein-proposed vibrator is simple in construction and convenient in operation. Due to the provision of slots in the core and in the magnetic yokes, the operating vibrator causes the rod to reciprocatingly move both along and around its own axis. Thus, oscillating motion is imparted to the grinding-solid chamber, the motion conductive to an efficient disintegration of material.

It is quite reasonable that the material charging chamber and the grinding-solid chamber be intercommunicated through a hole within whose zone the rod has a cone-shaped boss, the boss with its tapered portion facing the material charging chamber, whereby the material is fed in metered portions into the grinding-solid chamber during operation of the apparatus.

Such a proportioning device is simple in construction and reliable in operation.

To provide a stepless control of the rate of material feed into the grinding-solid chamber, the rod may be mounted in the tube with a possibility of travelling along its own axis to assume a variety of fixed positions with respect to its axis.

Thus, to increase or decrease the rate of material feed, it is necessary to lower or raise the rod, respectively.

The rod portion housed in the charging and rigidly connected to the grinding-solid chamber may be made as a tube with holes (ports) to equalize the pressure inside the chambers.

BRIEF DESCRIPTION OF THE DRAWINGS

Other objects and essential advantages of the herein-disclosed invention will hereinafter become more evident from a detailed description of an exemplary embodiment thereof with due reference to the accompanying drawings, wherein.

DETAILED DESCRIPTION OF THE PREFERRED EMBODIMENT

Figure 1:
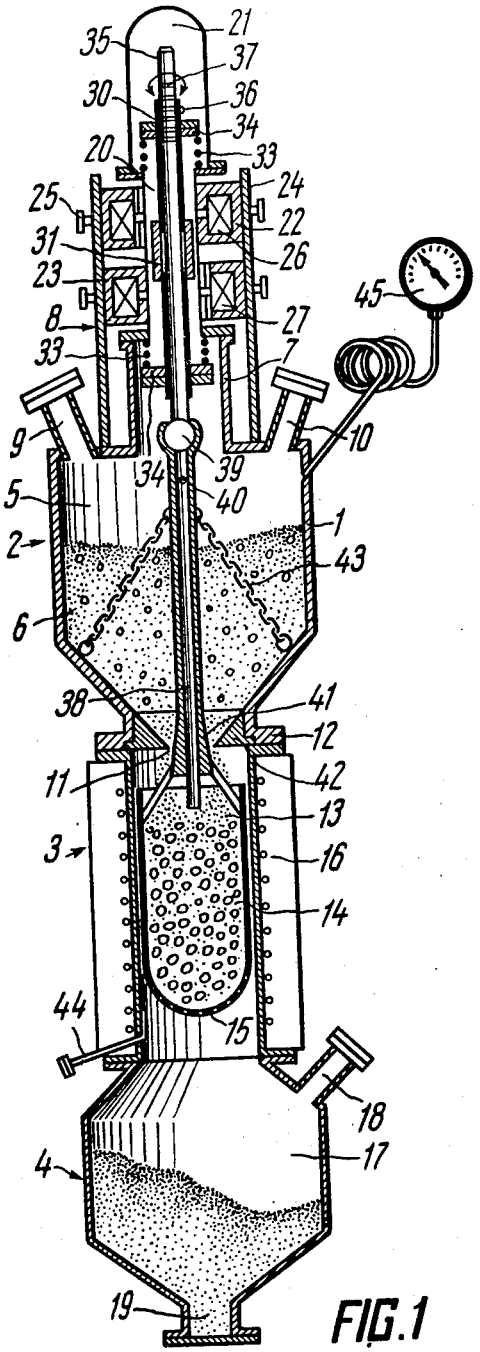
FIG. 1 is a longitudinal section view of an apparatus for disintegration of material, according to the invention.

The apparatus comprises an airtight shell, with three intercommunicating compartments 2, 3 and 4.

A top compartment 2 serves as a charging chamber 5 for a material 6. The chamber 5 is funnel-shaped and its top portion has a central pipe 7 carrying a magnetic vibrator 8. Also, the chamber 5 is provided with two pipes 9 and 10, one of which serves for feeding the material 6 into the chamber 5, while the other pipe is adapted for visual observation of the level of the material 6 in the chamber 5. The bottom portion of the chamber 5 has a hole 11 and a flange 12 through which the chamber is communicated with the middle compartment 3.

The middle compartment 3 is cylinder-shaped and houses a chamber 13 with grinding solids 14, the chamber being made in the form of an open cylindrical container whose bottom is provided with holes 15 to discharge the disintegrated product into the lower compartment 4. The diameter of the holes 15 dows not allow the grinding solids to pass through the holes 15.

The grinding solids 14 may be made of any hard material and shaped as a ball, a cylinder, a tetrahedron, a prism, etc. The chamber 13 is mounted in the compartment 3 with a minimum gap with respect to the wall of the shell 1, which gap should be enough for the chamber 13 to freely pass and an effective heat exchange between the chamber 13 and the shell 1 of the apparatus to occur. From the outside the middle compartment 3 is embraced with a heat exchanger 16 to ensure the required temperature in the chamber 13. The inventors have been successful in using resistance heating elements as the components of the heat exchanger unit. However, a coil filled with coolant may also be used instead of heating elements whenever a necessity arises to lower the temperature inside the chamber 13.

The bottom compartment 4 serves as a chamber 27 for discharge of the disintegrated products fed from the chamber 13. The chamber 17 has a pipe 18 for letting the gaseous products in or out, while its bottom is provided with a drain pipe 19 for letting the solid or liquid products out therefrom.

Figure 2:
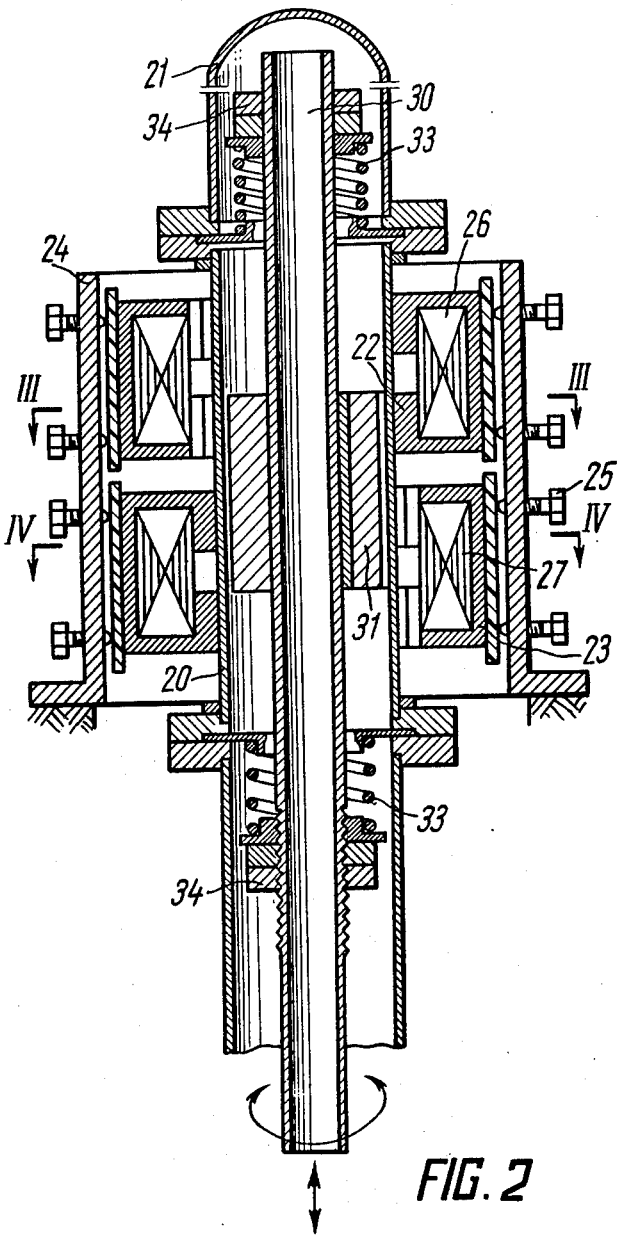
FIG. 2 is a longitudinal section view of a vibrator of the apparatus, according to the invention.
Figure 3:
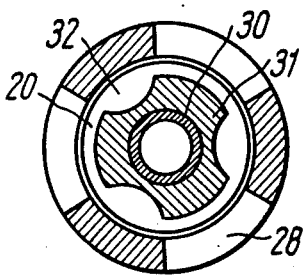
FIG. 3 is a cross-sectional view taken along the line III — III in FIG. 2.
Figure 4:
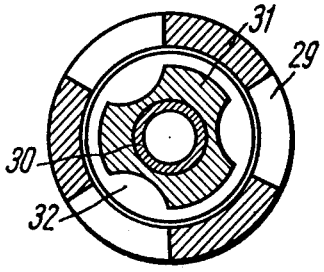
FIG. 4 is a cross-sectional view taken along the line IV —IV in FIG. 2.
Figure 5:
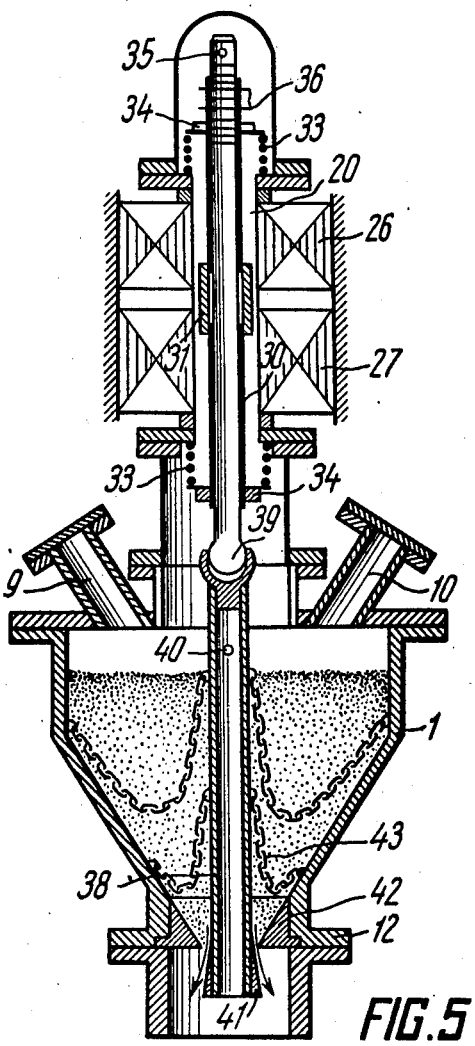
FIG. 5 is a longitudinal section view of a material changing chamber, of the apparatus, according to the invention.

The magnetic vibrator 8 (FIGS 1 through 4) contains sleeve 20 made of a non-magnetic material, the sleeve being fixed on the pipe 7 of the chamber 5 and resting upon the shell 1.

From above the sleeve 20 is covered with a cap 21, while from outside the sleeve mounts two closed (annular) magnetic yokes 22 and 23 which are held in position with the use of a carrier 24 and screws 25.

Solenoid coils 26 and 27 are arranged inside the magnetic yokes 22 and 23. The inner surface of the magnetic yokes 22 and 25 has longitudinal slots 28 and 29.

Housed inside the sleeve 20 is a metal tube 30 with an annular core 31 rigidly secured on the tube outer surface. The outer surface of the core 31 is provided with longitudinal slots 32. The tube 30 is suspended on springs 33, the springs being pressed against the ends of the sleeve 20 by nuts 34. The screws 25 and nuts 34 are also used for proper positioning of the magnetic yokes 22 and 23 with respect to the core, the magnetic yokes being so positioned that the slots 28 of the magnetic yoke 22 be offset with respect to the slots 29 of the magnetic yoke 23, whereas the core 31 is positioned inside the gap provided between the magnetic yokes 22 and 23.

Fixed inside the tube 30 is rod 35 which is held therein by a pin 36 inserted into one of several holes 37. The portion of the rod 35, passing through the chamber 5, is made as a tube 38 and is articulated with the other portion of the rod 35 by a joint 39.

The tube 38 within the zone of the central pipe 7 is provided with a port 40 to equalize the pressure inside the chambers 5 and 13. The chamber 13 is suspended from the bottom end of the rod 35.

The rod 35 has a cone-shaped boss 41 within the zone of the hole 11 provided between the chamber 5 and the compartment 3, the boss with its tapered portion facing the chamber 5. The flange 12 mounts a variable orifice plate 42. The material 6 is fed to the chamber 13 through the gap provided between the boss 41 and the orifice plate 42. The amount of the gap mainly depends on the position of the cone-shaped boss 41 of the rod 35 in the orifice of the plate 42. When the rod 35 moves downward, the gap increases and vice versa. Thus, a stepless control of the rate of the material feed from the chamber 5 into the chamber 13 is attained by moving the rod either upwards or downward.

Secured on the tube 38 are chains 43 for loosening the material 6 in the chamber 5. The compartment 5 accommodates a thermocouple 44 for checking the temperature inside the compartment.

The shell 1 mounts a pressure gauge 45 for measuring the pressure inside the apparatus.

The apparatus for disintegration of material, when used for performing various chemical processes concerned with disintegration of solid materials, e.g., for production of borazine, functions as described below.

Prior to charging the material 6, the apparatus interior is cleaned of impurities and dried with a view to removing the moisture therefrom. This done, the chamber 5 is charged through the pipe 9 with a mix of definite proportions of dry powdered materials. The apparatus is hermetically sealed and evacuated with the use of a vacuum pump (not shown in the drawings and, whenever, necessary, the apparatus interior is filled with an inert gas, e.g., argon. When the heat exchanger unit 16 is energized to bring the temperature inside the chamber 13 to the required level. In the herein-considered particular case with borazine synthesis the temperature should be brought to 200° – 250°C. The solenoid coils 26 and 27 are connected to the supply mains through the electronic unit the power circuit of which is built around a thyristor circuit (not shown in the drawings). During operation of the apparatus, the coils 26 and 27 are automatically switched at a controllable rate. The control limits of the switching rate of the coils 26 and 27 lie within a wide range.

With the solenoid coils 26 and 27 energized alternately, the core 31 is attracted to either the coil 26 or 27 to assume such a position, in which the slots 28 or 29 of either the magnetic yoke 22 or 23 coincide with the slots of the core 31. Thus, with the coils 26 and 27 energized alternately, the core 31 along with the rod 35, and, consequently, the chamber 13 with the grinding solids 14 will reciprocatingly move along and around the axis of the rod 35. In this case reciprocating motion is imparted to the material in the chamber 5 with the use of the chain 43 and the boss 41 of the rod 35, which contributes to a proper passing of the material 6 into the chamber 13 through the gap provided between the orifice plate 42 and the boss 41. The feed rate of the material 6 is determined by the gap and is adjusted by appropriately setting the rod 35 in the tube 30.

When oscillating motion is imparted to the chamber 13, the material 6 fed from the superfacent chamber 5, passes through a layer of the grinding solids 14 and leaves the chamber 13 through the holes 15 provided in the chamber bottom. As a result, the material 6 under process grows hot and gets ground and disintegrated, as well as undergoes chemical transformations that can be accompanied with evolution of gaseous or liquid products, e.g., hydrogen is thus evolved in the case of borazine synthesis. The gaseous products are continuously exhausted by pumping through the outlet pipe 18 of the chamber 17 and further on, through the liquid-nitrogen cooled traps (not shown in the drawings). As a result, the segration of gaseous components takes place, of which the borazine is liquified, whereas the other gases are free to escape.

The solid disintegrted are accummulated on the bottom of the chamber 17.

The rate of feed of the material 6 (a mix of powdered materials) from the chamber 5 into the chamber 13 is selected so as to comply with the running of the chemical processes involved during the passing of the material 6 through the chamber 13. The operation of the chamber 5 is checked visually through the pipe 10, the pressure of gases is measured against the pressure gauge 45, while the temperatures inside the apparatus is measured by reference to the thermocouple 44.

As soon as the material under process leaves the chamber 5, the solid disintegrated products are discharged through the drain pipe 19 and thus the entire process is recycled.

What we claim is:

1. An apparatus for disintegration of solid materials, comprising: an airtight shell with three intercommunicating compartments, of which the top one serves as a material charging chamber and has an inlet pipe for material to be charged, the middle compartment accommodates a chamber with grinding solids, while the bottom compartment serves as a chamber for discharge of disintegrated products; a vibrator mounted on the shell and provided with a rod inserted into the material charging chamber so that the rod is mechanically disengaged from the shell and is rigidly connected to the grinding-solid chamber to impart oscillating motion to the grinding-solid chamber.

2. The apparatus as claimed in claim 1, wherein the rod portion passing beyond the material charging chamber is fixed to a tube containing a core, the tube being associated with the shell through springs and housed in a sleeve which is sealingly connected to the interior of the shell and is embraced with a pair of solenoid coils fitted in magnetic yokes, the core being provided with longitudinal slots, whereas the internal surface of the magnetic yokes has slots so arranged that, when the core assumes a definite position, its slots are situated opposite the slots in one of the magnetic yokes.

3. The apparatus as claimed in claim 2, wherein the material charging chambers and the grinding-solid chamber intercommunicate through a hole within whose zone the rod has a cone-shaped boss, the boss with its tapered portion facing the material charging chamber, whereby the material is fed in metered portions into the grinding-solid chamber during operation of the apparatus.

4. The apparatus as claimed in claim 2, wherein the rod portion is mounted in the tube and adapted to travel along its own axis to assume a variety of fixed positions.

5. The apparatus as claimed in claim 2, wherein the rod portion housed in the charging chamber and rigidly connected to the grinding-solid chamber is made as a tube with a port for equalizing the pressure in the chambers.

* * * * *